US010544560B2

(12) United States Patent
Halischuk

(10) Patent No.: US 10,544,560 B2
(45) Date of Patent: Jan. 28, 2020

(54) SELF CLEANING BUCKET ASSEMBLY FOR A DIGGING MACHINE

(71) Applicant: Cory Halischuk, Clandeboye (CA)

(72) Inventor: Cory Halischuk, Clandeboye (CA)

( * ) Notice: Subject to any disclaimer, the term of this patent is extended or adjusted under 35 U.S.C. 154(b) by 0 days.

(21) Appl. No.: 16/149,780

(22) Filed: Oct. 2, 2018

(65) Prior Publication Data

US 2019/0169815 A1 Jun. 6, 2019

Related U.S. Application Data

(60) Provisional application No. 62/594,123, filed on Dec. 4, 2017, provisional application No. 62/690,155, filed on Jun. 26, 2018, provisional application No. 62/716,108, filed on Aug. 8, 2018.

(51) Int. Cl.

| | |
|---|---|
| ***E02F 3/407*** | (2006.01) |
| ***E02F 3/36*** | (2006.01) |
| ***E02F 3/42*** | (2006.01) |
| ***E02F 3/40*** | (2006.01) |

(52) U.S. Cl.

CPC ..... *E02F 3/3677* (2013.01); *E02F 3/40* (2013.01); *E02F 3/407* (2013.01); *E02F 3/42* (2013.01)

(58) Field of Classification Search

CPC ..... E02F 3/407

See application file for complete search history.

(56) References Cited

U.S. PATENT DOCUMENTS

| | | | | |
|---|---|---|---|---|
| 2,402,299 | A * | 6/1946 | Schield | E02F 3/4075 414/725 |
| 2,719,641 | A * | 10/1955 | Pilch | E02F 3/30 414/704 |
| 2,720,990 | A | 10/1955 | Beuerstedt | |
| 2,812,872 | A * | 11/1957 | Perkins | E02F 3/30 414/704 |
| 2,858,035 | A | 10/1958 | Mettetal, Jr. | |
| 3,143,227 | A * | 8/1964 | Wiemann | E02F 3/407 414/695 |
| 3,176,863 | A * | 4/1965 | Kuhl | E02F 3/283 414/725 |
| 3,229,835 | A | 1/1966 | Watts | |
| 3,346,974 | A * | 10/1967 | Haynes | E02F 3/407 37/409 |
| 3,380,604 | A * | 4/1968 | Leese | E02F 3/407 414/694 |

(Continued)

*Primary Examiner* — Matthew Troutman

(74) *Attorney, Agent, or Firm* — Adrian D. Battison; Ade & Company Inc; Ryan W. Dupuis

(57) ABSTRACT

A bucket assembly for mounting on a boom of a digging machine comprises a bucket with an outer wall and a rear wall pivotally mounted between side walls of the bucket so that the rear wall is movable relative to the outer wall for discharging material from the bucket. In one arrangement this relative movement is provided by a linkage assembly which displaces the rear wall forwardly as the remainder of the bucket continues to move rearwardly to a retracted position of the bucket. In another arrangement the relative movement is provided by at least one stopper fixed in relation to the boom arranged for engaging the pivotal rear wall in an angularly intermediate position of the bucket such that the rear wall moves forwardly relative to the outer wall as the bucket moves rearwardly to its retracted position.

16 Claims, 8 Drawing Sheets

(56) References Cited

U.S. PATENT DOCUMENTS

| | | | | | |
|---|---|---|---|---|---|
| 3,421,236 | A * | 1/1969 | Moyer | E02F 3/407 | 37/409 |
| 3,426,928 | A * | 2/1969 | Campbell | E02F 3/407 | 414/704 |
| 3,495,728 | A | 2/1970 | Long | | |
| 3,539,069 | A * | 11/1970 | Anderson | E02F 3/3408 | 414/704 |
| 3,642,160 | A * | 2/1972 | Rockwell | E02F 3/407 | 414/704 |
| 3,837,516 | A * | 9/1974 | Meyer | E02F 3/407 | 414/704 |
| 3,872,986 | A | 3/1975 | Campbell | | |
| 4,032,015 | A * | 6/1977 | Hemphill | E02F 3/32 | 414/704 |
| 6,658,769 | B2 * | 12/2003 | Klager | B66C 3/02 | 37/444 |
| 7,260,903 | B2 * | 8/2007 | Arp | E02F 3/407 | 37/431 |
| 2005/0193601 | A1 * | 9/2005 | King | E02F 3/407 | 37/411 |

* cited by examiner

SELF CLEANING BUCKET ASSEMBLY FOR A DIGGING MACHINE

This application claims the benefit under 35 USC 119 ( ) of provisional application 62/594,123 filed Dec. 4, 2017, of provisional application 62/690,155 filed Jun. 26, 2018 and of provisional application 62/716,108 filed Aug. 8, 2018 the disclosures of which are incorporated herein by reference.

This invention relates to a self-cleaning bucket assembly for mounting on the boom of a digging machine.

BACKGROUND OF THE INVENTION

Previous attempts have been made to provide a bucket which is self-clearing in that it provides a member which actively discharges contained material within the bucket to ensure that the bucket is fully emptied for another stroke, thus significantly increasing productivity as each load fills the bucket and is fully emptied. This is particularly important where the material being lifted is sticky or otherwise does not flow easily from the bucket leaving significant amounts of material within the bucket. However little success has been obtained.

SUMMARY OF THE INVENTION

It is one object of the invention to provide an improved bucket of this general type.

According to the invention there is provided a bucket assembly for mounting on a boom of a digging machine comprising:

a mounting coupling for attachment to the boom for pivotal movement of the coupling about an axis transverse to the boom;

a bucket attached to the mounting coupling for pivotal movement about the pivot axis in a digging action;

the boom including a hydraulic operating cylinder mounted thereon for operating pivotal movement of the bucket with an operating linkage extending from the cylinder to the bucket for pivotal movement of the bucket about a bucket pivot axis between forward and retracted positions;

the bucket having an outer wall of the bucket with a front digging edge to cut into material to be lifted and with the outer wall trailing behind the front edge;

the bucket having side walls of the bucket for confining the material onto the outer wall;

the bucket having a rear wall fixed to the outer wall and attached to the mounting coupling;

a pivotal cleaning wall of the bucket being mounted on the bucket for pivotal movement about an axis transverse to the bucket at or adjacent the rear wall so as to be movable from a retracted position at the rear wall to a forward position in which the pivotal cleaning wall moves forwardly relative to the outer wall to push material from the outer wall for discharge;

the outer wall forming a part of a cylinder surrounding the transverse axis of the pivotal cleaning wall so that pivotal movement of the pivotal cleaning wall about the axis causes an outer edge of the pivotal cleaning wall to sweep across the outer wall from the position at the rear wall to a position adjacent a front of the part of the cylinder and causes respective side edges of the pivotal cleaning wall to sweep over the side walls;

and a cleaning linkage connected to the boom and extending therefrom forwardly to a forward end which, when the bucket moves rearwardly, extends through an opening in the rear wall and contacts the pivotal cleaning wall for pushing pivotal movement of the cleaning wall between the retracted and forward positions thereof;

the cleaning linkage being connected to the boom by a coupling which allows pivotal movement of the forward end of the linkage relative to the boom;

the cleaning linkage being arranged such that the pivotal cleaning wall is pushed forwardly as the bucket moves rearwardly.

Preferably the bucket is connected by a quick-release coupling attached to the boom and the operating linkage of the hydraulic cylinder which can be quick attached to and released from the rear wall. This coupling reduces access availability to the rear wall and requires special locations of the cleaning linkage as described hereinafter.

Preferably the transverse axis of the pivotal cleaning wall is positioned at a location different from the bucket pivot axis so that the bucket pivot axis is outside the bucket at the coupling member and the transverse axis is within the bucket in front of the rear wall.

Preferably the pivotal cleaning wall is biased by a spring toward the retracted position at the rear wall.

Preferably the rear wall has one or more openings to allow release of any material from behind the pivotal cleaning wall and to allow penetration into the bucket of the cleaning linkage which engages the cleaning wall.

Preferably the cleaning linkage includes an elongate stiff pushing member which is straight so as to push along its length.

Preferably the cleaning linkage engages a receptacle carried on the pivotal cleaning wall of the bucket.

Preferably the receptacle comprises a cup which allows movement of an end pf the pushing member radially of the transverse axis.

Preferably the receptacle is carried on a member projecting outwardly from the pivotal cleaning wall so that the receptacle is spaced rearwardly of the pivotal cleaning wall.

Preferably a rear end of the cleaning linkage is carried for pivotal movement on a pivot carried on a support bracket attached to the boom.

In one arrangement a rear end of the cleaning linkage is carried for pivotal movement on a pivot attached to the boom by a bracket which supports the pivot at a position spaced from the boom with the cylinder between the pivot and the boom. This allows the linkage to project through an opening in the rear wall between the coupling of the boom on the bucket at the rear wall and the ourt wall. Thus the linkage can be a single member which is relatively wide and extends through a single central hole in the rear wall of the bucket.

Preferably in this arrangement the support bracket includes a forward clamping portion bolted to the boom and rear extension portion extending along the boom over the cylinder to attach to a mounting of the rear end of the cylinder. This provides a solid mounting point for the linkage and also provides protection for the cylinder which can reduce impact damage. In this case the cleaning linkage comprises a plate extending through a hole in the rear wall centrally between the side walls and located outwardly of the transverse axis between an outer edge of a bucket coupler and the outer wall.

In an alternative arrangement, the rear end of the cleaning linkage is carried for pivotal movement on a pivot attached to the boom where the pivot is at a position located at or closely adjacent the boom underneath the cylinder. In this case the cleaning linkage must extend along a side of the cylinder and hence must be relatively narrow and extend through a slot along the side of the coupler so that it is desirable to provide two such fingers one on each side of the cylinder and the coupler.

In this case therefore the cleaning linkage comprises a pair of fingers each extending through a respective hole or slot in the rear wall between a side edge of a bucket coupler and a respective side wall.

Preferably the cleaning linkage can be retracted to a non-active position by pivotal movement to engage a latch. This is done by folding the linkage back through 90 degrees to a position along the boom.

Preferably the cleaning linkage is biased by a spring toward the transverse axis.

Preferably the stiff pushing member is straight so that a pushing action extends along the stiff pushing member.

Preferably an abutment on the cleaning linkage acts to engage the operating linkage and to hold the cleaning linkage into a required position on the cleaning wall as the bucket moves rearwardly.

Preferably the the pivotal cleaning wall is generally planar from the transverse axis to the outer edge.

Preferably there is provided at least one stop member mounted on a side wall to prevent movement of the pivotal cleaning wall outside a front of the outer wall.

Preferably the bucket is oversize relative to conventional buckets for the digging machine. In particular the bucket can be significantly deeper as the material is actively discharged. Depths of up to 3 or even 4 feet are possible allowing the bucket to be used for narrow trenching. This is possible as the bucket can be very deep and very narrow, less than 12 or even 9 inches without the material hanging up within the very narrow confines.

In another arrangement which can be used, the link which operates the movement of the cleaning wall comprises a flexible member for example a chain which pulls on the cleaning wall from in front of the wall.

Preferably the flexible member includes two portions one on each side of the rear wall.

Preferably there is provided an abutment member over which the flexible member passes which moves with the rear wall to increase the distance from the end of the flexible member at the rear wall to an opposed end of the flexible member at the boom so that the flexible member causes a greater movement of the rear wall.

Preferably the abutment member extends forwardly from the rear wall.

Preferably the abutment member comprises a bar across the rear wall forwardly from the rear wall.

Preferably the end of the flexible member remote from the rear wall is attached to a position of the operating linkage which moves away from the rear wall as the bucket is moved rearwardly.

Preferably the end of the flexible member remote from the rear wall is attached to a lever of the operating linkage which moves away from the rear wall as the bucket is moved rearwardly to apply an additional pull on the rear wall.

Preferably the finger carries a front rod across the front of the finger which is received in a channel shape of the receptacle.

Preferably the receptacle is carried on a post projecting outwardly from the rear wall.

Preferably the rear end of the finger is carried for pivotal movement on a pin attached to a support bracket attached to the boom.

Preferably the support bracket includes a forward clamping portion bolted to the boom and rear extension portion extending along the boom over the cylinder to attach to the mounting of the rear end of the cylinder.

Preferably there are provided stiffening ribs on the top and bottom of the plate.

BRIEF DESCRIPTION OF THE DRAWINGS

Preferred embodiments of the invention will now be described in conjunction with the accompanying drawings in which.

DETAILED DESCRIPTION

Figure 1:
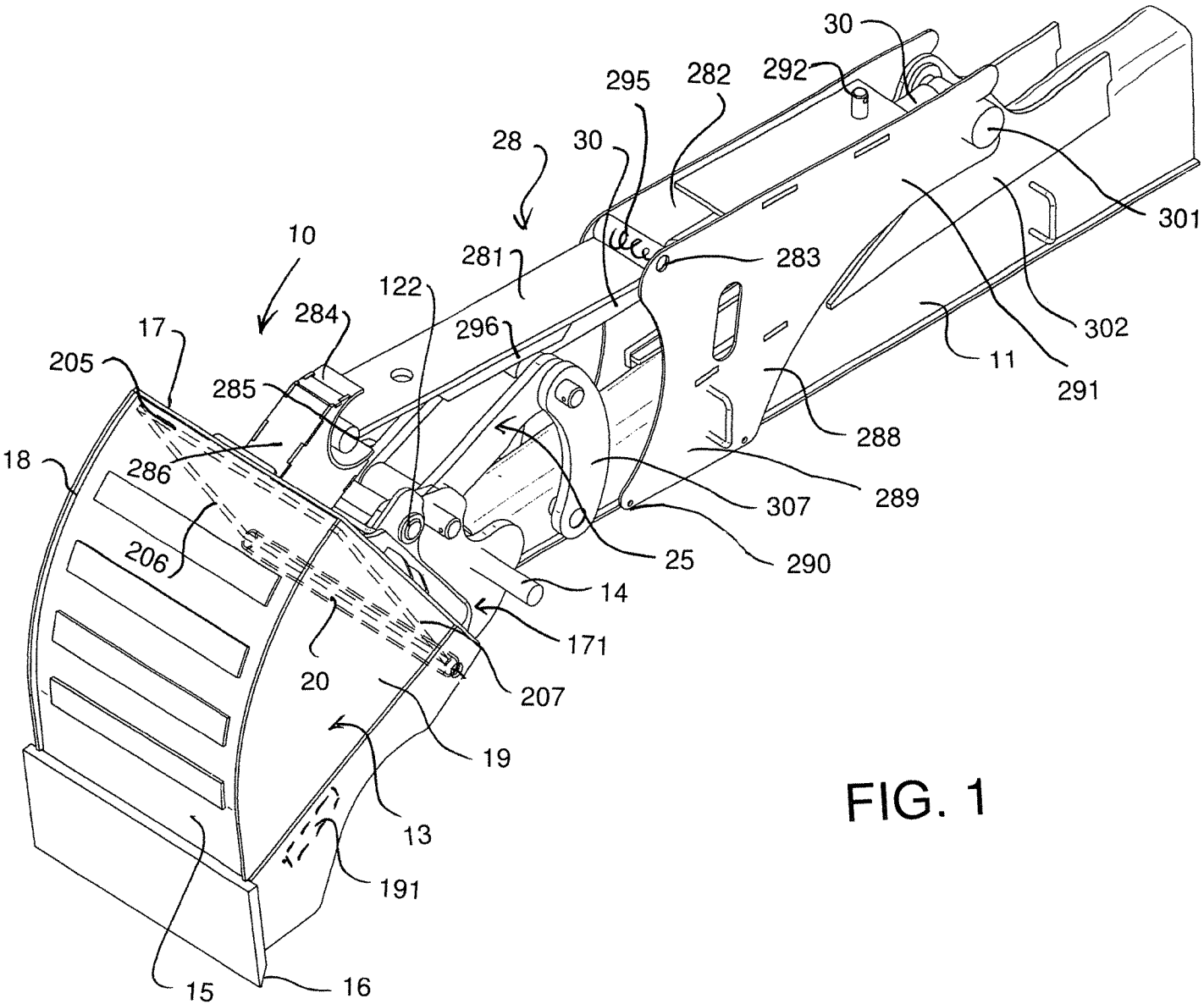
FIG. 1 illustrates an isometric view of one embodiment of device according to the present invention.

A bucket assembly 10 for mounting on a boom 11 of a digging machine, for example an excavator, includes a quick release mounting coupling 12 for attachment to the boom. A bucket 13 is attached to the coupling 12 for pivotal movement about a pivot pin 14 defining a pivot axis in a digging action. The bucket has an outer part cylindrical wall 15 with a front digging edge 16 to cut into material to be lifted and with the outer wall trailing behind the front edge to a rear edge 17. The bucket has side walls 18, 19 for confining the material onto the outer wall. A rear wall 171 of the bucket at the coupling 12 is attached cross the rear face of the bucket at the rear edge 17 and is connected to the outer wall and to the side walls.

Figure 2:
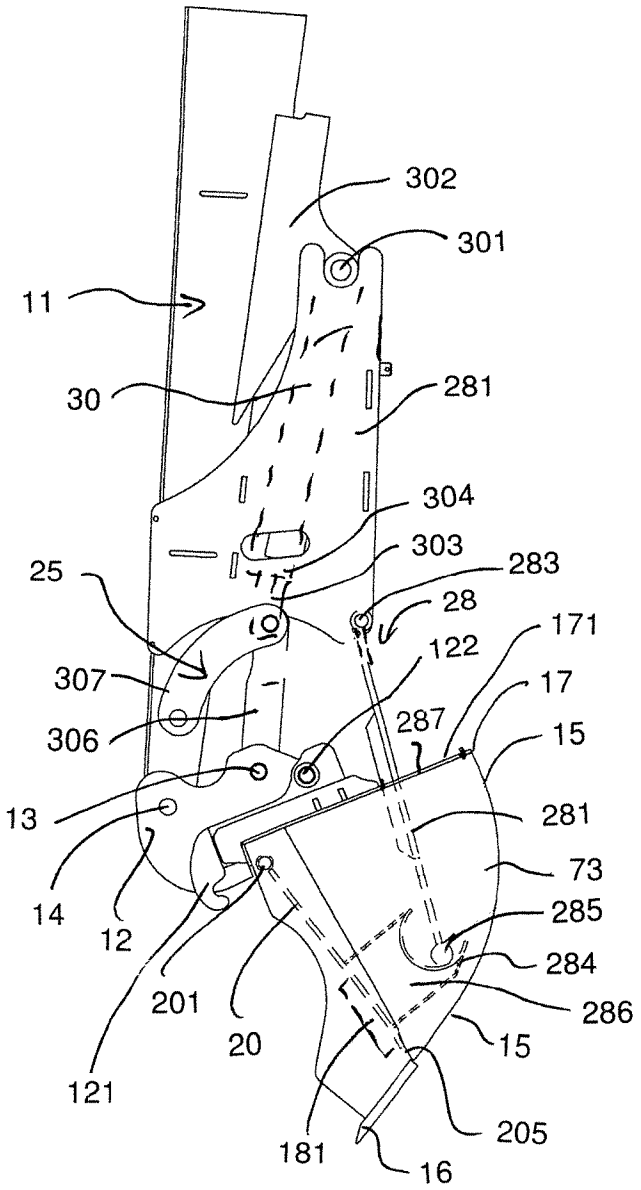
FIGS. 2, 3 and 4 show a side elevational views of the device of FIG. 1 in the different positions as the bucket moves from the fully emptied position in FIG. 2 to the loaded position shown in FIG. 4.
Figure 3:
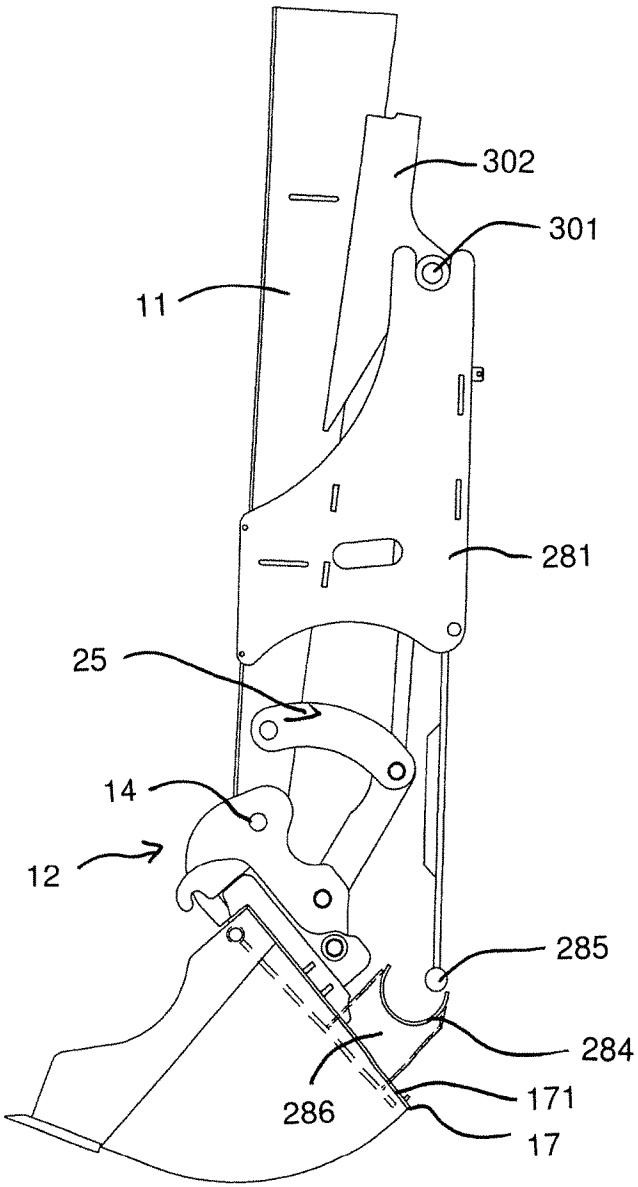

A pivotal cleaning wall 20 of the bucket is mounted on the bucket 12 at a transverse pivot pin 201 across the bucket at or just in front of the rear wall 171 on for pivotal movement relative to the outer wall of the bucket. The pivotal cleaning wall 20 which is generally planar and radial to the pin 14 and the part cylindrical outer wall 15 is thus movable from a retracted position at the rear wall 171 at the rear edge of the outer wall 15 to a forward position in which the pivotal cleaning wall 20 moves forwardly relative to the outer wall 15 to push material from the outer wall for discharge. Each of these two positions may be more clearly seen by reference to FIGS. 2 and 3, where the retracted position is illustrated in FIG. 3 and the forward position is illustrated in FIG. 2. Typically, the pivotal cleaning wall 20 is positioned in its retracted position for digging of material and in its forward position for dumping of material from the bucket 13.

A linkage 25 connected to an operating cylinder 30 of the digging machine for operating the system includes a first link 26 for actuating pivotal movement of the bucket between forward and retracted positions. The cylinder 30 is connected at a rear end 301 to a bracket 302 carried on the boom so that a piston rod 303 at a forward end 304 of the cylinder can push and pull on a link 306 attached to the coupler 12. Operation of the linkage 25 thus causes the coupler 12 to pivot about the pin 14 at the end of the boom 11. A guide link 307 controls the movement of the link 306 when operated by the cylinder.

This type of mounting coupling 12 is well known in the prior art and typically supplied by many manufacturers of this type of equipment. The mounting coupling 12 is of a quick release type in which the coupling 12 remain son the boom and connects by a snap fastening to the bucket defined by fasteners 121 and 122.

A link assembly 28 which operates movement of the pivotal cleaning wall 20 includes a pivotal lever 281 pivotally mounted on a bracket 282 at a pin 283 which operates to push on the pivotal cleaning wall 20 at a receptacle 284.

The lever 281 forms a pushing finger or member to move the pivotal cleaning wall 20 forwardly in the bucket. Thus the pushing member 281 passes through a hole 287 in the back wall 171 of the bucket and engages the receptacle 284 carried on the pivotal cleaning wall 20.

The finger 281 carries a front rod 285 across the front of the finger which is received in a channel shape of the receptacle 284 with a front opening into which the rod passes to engage against the semi-cylindrical rear wall of the receptacle. The receptacle is carried on a post 286 projecting outwardly from the pivotal cleaning wall 20 through the opening 287 to hold the receptacle at a required location so that the rod engages into place as the bucket is pulled rearwardly by the linkage 25 attached to the cylinder 30 carried on the boom 11.

The rear end of the finger 281 is carried for pivotal movement on a pin 283 attached to a support bracket 288 attached to the boom 11. Thus the support bracket 288 includes a forward clamping portion 289 bolted at 290 on the underside of the boom 11 and rear extension portion 291 extending along the boom over the cylinder 30 to attach to the mounting 301 of the rear end of the cylinder. In this way the bracket 289 is easily mounted in place on the boom and easily removed when not required. The elongate shape of the bracket 289 along the boom provides the necessary structural strength to accommodate the loads on the finger 281 when pushing heavy sticky materials from the bucket.

The finger 281 can be retracted to a non-active position by pivotal movement around the pin 283 to engage a latch 292 on the rear end of the bracket to hold the end of the finger with the rod 285 engaging the latch 292 to hold it in retracted position. A spring 295 acts to bias the finger into the forward position around the pin 283 toward the linkage 25.

The finger 281 forms a planar plate having a width across the bucket to provide increased strength against bending under the loads. A stiffening ribs 296 on the bottom face can increase this stiffness. The rib 296 forms an abutment on the link plate which acts to lift the plate 281 and its front rod 285 into the cup shaped receptacle 284 as the bucket moves rearwardly. Thus the abutment 296 is dimensioned when sliding over a cooperating wear surface on the link 307 to guide the rod so that it is held at the correct height to engage into the cup or receptacle as the bucket is moved rearwardly.

The pivotal cleaning wall 20 of the bucket is thus mounted on the bucket for pivotal movement about the axis of the pin 20 transverse to the bucket at or adjacent the rear wall 171 so as to be movable from the retracted position at the rear wall 171 to the forward position in which the pivotal cleaning wall moves forwardly relative to the outer wall to push material from the outer wall for discharge.

The outer wall 15 forms a part of a cylinder surrounding the transverse axis 201 of the pivotal cleaning wall 20 so that pivotal movement of the pivotal cleaning wall about the axis causes an outer edge 205 of the pivotal cleaning wall 20 to sweep across the outer wall 15 from the position at the rear wall to a position adjacent a front of the part of the cylinder and causes respective side edges 206, 207 of the pivotal cleaning wall to sweep over the side walls. This sweeping action is sufficiently close to provide a cleaning action breaking away any stuck material but typically without contact between the components which could cause binding.

The cleaning linkage 28 is connected to the boom and extends from the boom forwardly to a forward end which, when the bucket moves rearwardly, extends through the opening in the rear wall and contacts the pivotal cleaning wall 20 for pushing pivotal movement of the cleaning wall 20 between the retracted and forward position.

Figure 4:
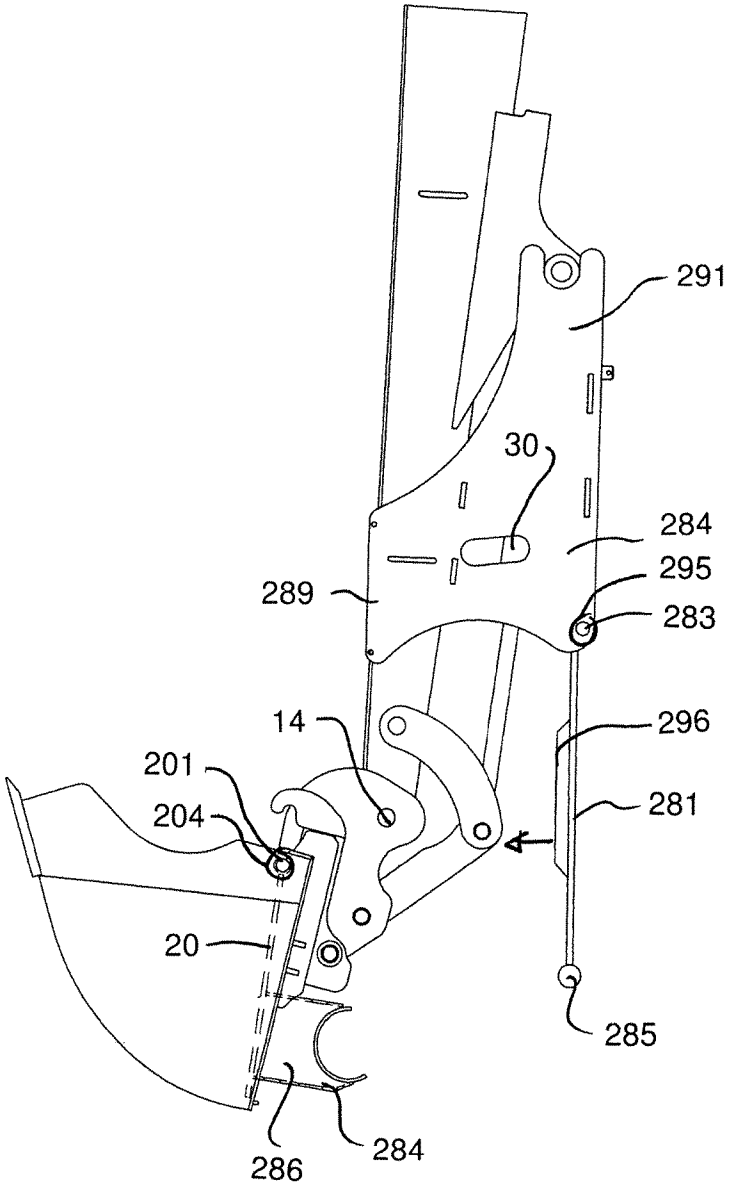
Figure 5:
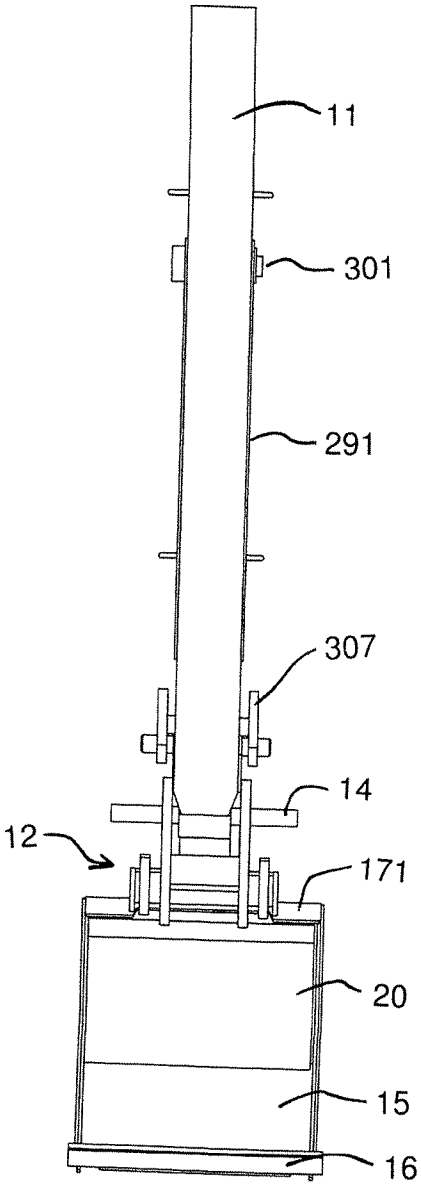
FIG. 5 is a front elevational view of the device of FIG. 1.

The cleaning linkage defined by the plate 281 is connected to the boom by the coupling or pin 283 which allows pivotal movement of the forward end 285 of the linkage relative to the boom 11. This allows relative movement of the forward end relative to its fixed mounting on the boom to accommodate the movement of the receptacle relative to the pivot location 14 of the bucket as the bucket moves rearwardly. This action causes the cleaning linkage to operate such that the pivotal cleaning wall 20 is pushed forwardly in the bucket as the bucket moves rearwardly in the discharging stroke. The discharge position is shown in Cross-section in FIG. 2. The starting position when the bucket is fully filled in a filling stroke and thus fully forward is shown in FIG. 3. FIG. 4 shows an intermediate position where the bucket is being pulled rearwardly for discharge and the forward end of the plate 281 is just about to enter the curved cup shaped receptacle 284. In the position of FIG. 4, the cleaning wall 20 is still retracted and is held in this position by a spring 204 and by the presence of the load in the bucket. It will be noted that the transverse axis 201 of the pivotal cleaning wall 20 is positioned within the bucket at a location different from the bucket pivot axis 14 on the coupling 12 so that relative movement occurs between the rod 285 and the receptacle 284 as the movement occurs.

The rear wall 171 has one or more openings 287 to allow release of any material from behind the pivotal cleaning wall if any gets behind the wall 20. Also this allows the receptacle to project through the opening to be presented as shown in FIG. 4 and for the plate 281 to pass through the opening in the position of FIG. 2. The cleaning linkage includes the elongate flat stiff pushing member 281 which is straight and inflexible so that it pushes along its length and does not need to bend or flex. This generates additional forces acting to push the wall 20 even in heavy loads and with large buckets. The receptacle 284 carried on the post or support on the rear face of the pivotal cleaning wall 20 of the bucket provides the required geometry by which the plate 281 can operate while being straight and without impacting the bottom edge of the opening 287 in the rear wall 171.

The receptacle comprises a semi-cylindrical cup which allows movement of the end rod of the pushing member radially of the transverse axis as it can take up a position determined by the direction of pushing action at any position across the cup.

The rear end of the plate 281 is carried for pivotal movement on a pivot pin carried on the support bracket 284 attached to the boom. This allows the position of the rod 285 to move closer to the pivot 14 of the bucket or further away to accommodate the required position as it changes during movement between the positions shown in FIGS. 2, 3 and 4.

The rear end of the plate 281 is carried for pivotal movement on the pivot pin 283. As shown in FIG. 3, this pin is attached to the boom by the bracket 284 which supports the pivot pin 283 at a position spaced from the boom 11 with the cylinder 30 between the pivot 283 and the boom 11, thus protecting the cylinder and ensuring that the plate 281 in its movement does not interfere with the action of the linkage operating the bucket. Thus the support bracket 284 includes a forward clamping portion 289 bolted to the boom and rear extension portion 291 extending along the boom over the cylinder 30 to attach to a mounting of the rear end of the cylinder.

In addition there is provided at least one stop member 181, 191 mounted on each side wall 18, 19 to prevent movement of the pivotal cleaning wall 20 outside a front of the outer wall 15.

Figure 6:
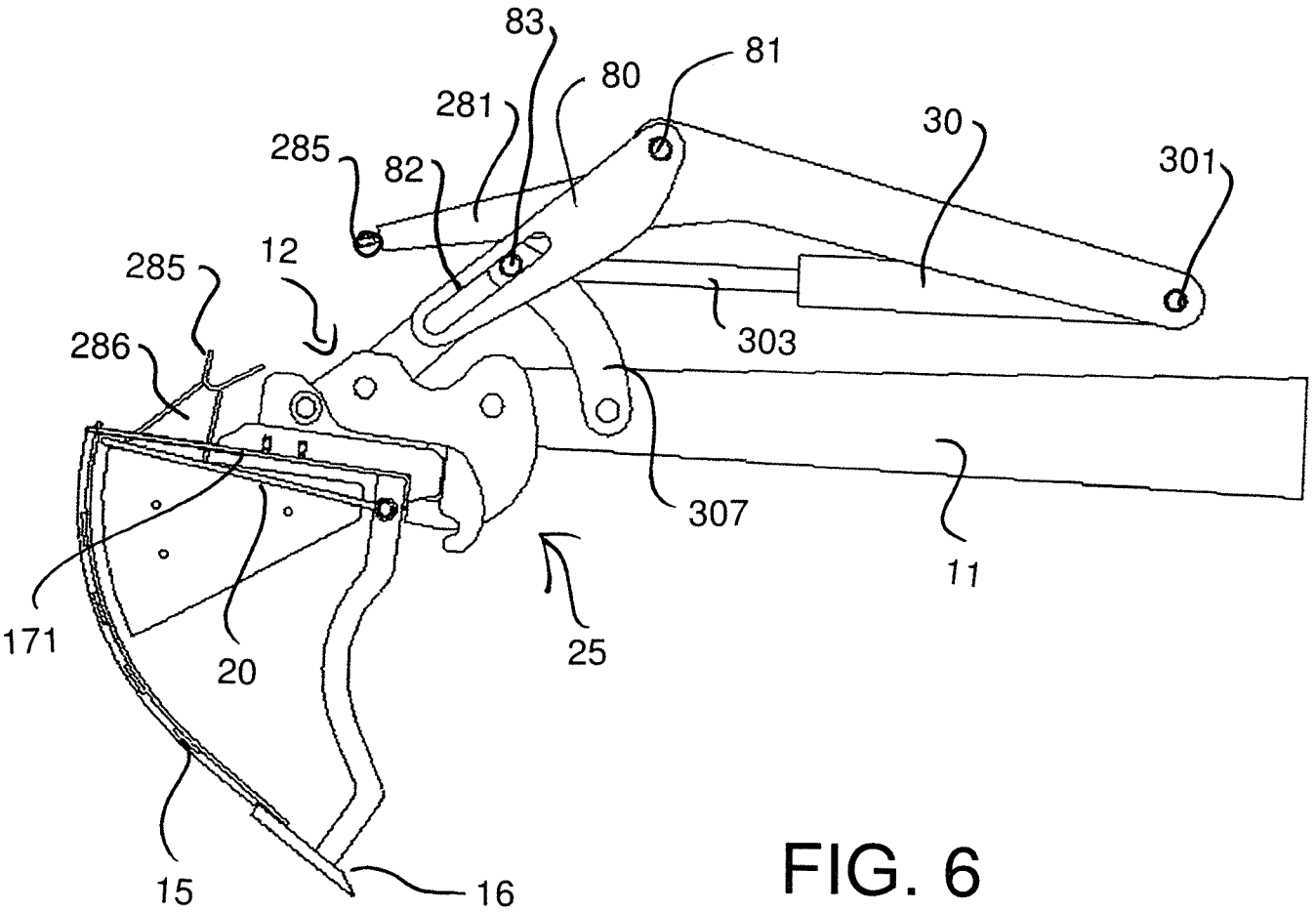
FIG. 6 shows in side elevational view another embodiment of device according to the present invention.

The embodiment of FIG. 6 is modified relative to that of FIGS. 1 to 5 in that the finger 281 is controlled in its movement by a link 80 attached to the finger 281 at a pin 81 having a slot 82 in which a pin 83 slides which is connected to the bucket operating linkage 25. Thus, it will be seen that the linkage 80 controls the position of the finger 281 and it forward rod 284 relative to the receptacle 285 and allows the finger to move relative to the linkage 80 so that it can follow the movement of the receptacle 285. The rear end of the finger is carried on the rear pin 301 of the cylinder 30.

FIG. 6 shows the bucket in a filled position. The bucket moves rearwardly from that position with the finger approaching the receptacle as the bucket moves toward the linkage. The finger enters the receptacle so that, as the bucket moves to its rearmost discharge position in which the cleaning wall 20 is pushed fully forwardly in the bucket and the finger moves on its guide link 80 away from the linkage 25 of the bucket with the pin 83 moving to the bottom of the slot 82.

Figure 7:
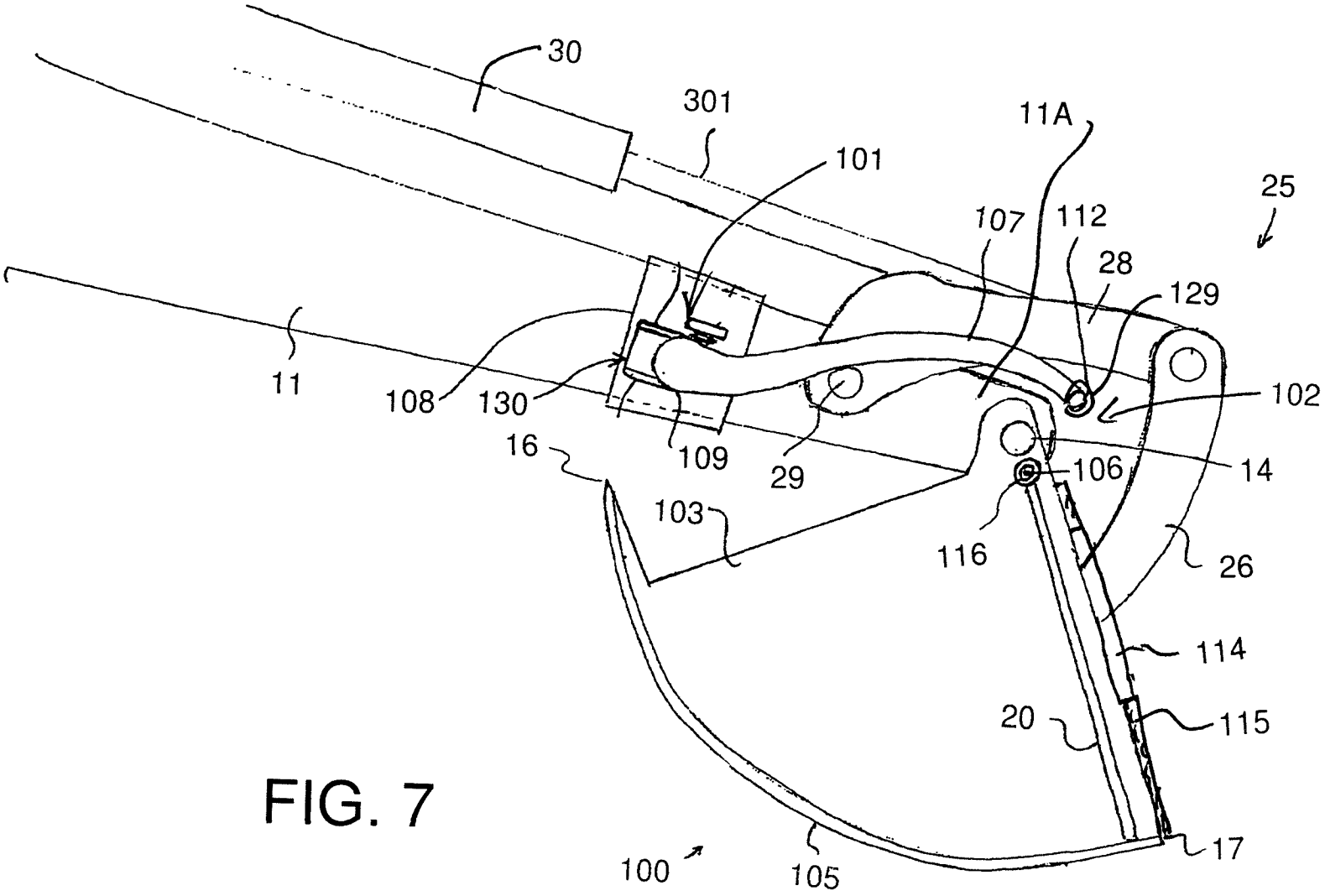
FIG. 7 shows in side elevational view another embodiment of device according to the present invention.
Figure 8:
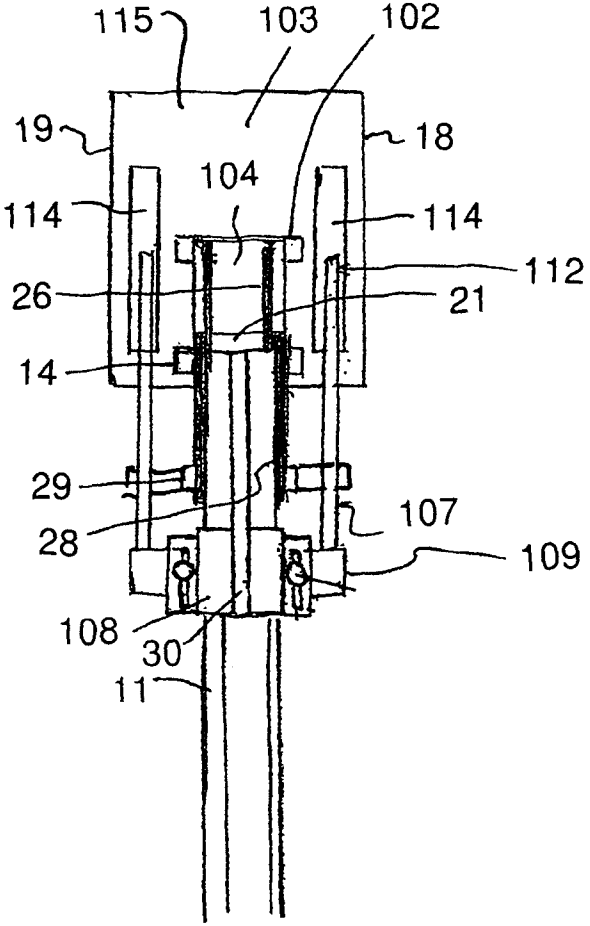
FIG. 8 is a front view of the device of FIG. 7.

There is illustrated more clearly in FIGS. 7 and 8 another embodiment of bucket assembly according to the present invention.

As shown in FIGS. 7 and 8 there is provided an arrangement in which the rear end of the cleaning linkage 107 is carried for pivotal movement on a pivot 101 attached to the boom 11 where the pivot is at a position located underneath the cylinder 30 with the cleaning linkage 107 extending along a side of the cylinder 30 in the form of a narrow finger.

More specifically, in FIGS. 7 and 8 there is shown a bucket assembly 100 for mounting on a boom 11 of the digging machine. The bucket assembly includes a mounting coupling in the form of a conventional quick coupler 102 (schematically shown) for attachment to a free end 11A of the boom. A bucket 103 is fixedly attached to the mounting coupling, and the mounting coupling 102 attaches to a cooperating coupling 104 (schematically shown) at the second end 11A of the boom so that the bucket is pivotal about a mounting coupling such as a conventional quick coupler defining a pivot axis 14 in a digging action. The mounting coupling in the style of a conventional quick coupler and components cooperative therewith on the boom are known to the person skilled in the art and thus not described in detail herein.

A typical digging machine generally comprises a frame including a main platform which is rotatable in the case of the excavator and a cab on the platform. The frame of the digging machine is supported for rolling movement on a support surface, typically the ground, by wheels or tracks at an underside of the platform. Additionally, the digging machine includes the boom 11 which is attached at a first end at the frame and has the second end 11A of the boom typically located at a spaced distance from the frame but which is positionable at a plurality of distances from the frame and above the support surface (i.e., ground) by a system of hydraulic cylinders operatively coupled in a conventional manner to provide same.

Returning to the bucket assembly 100, the bucket 103 has an outer part cylindrical wall 105 with a front digging edge 16 to cut into material to be lifted and with the outer wall trailing behind the front edge to a rear edge 17. The bucket has side walls 18, 19 for confining the material onto the outer wall.

A pivotal cleaning wall 20 of the bucket is mounted between the side walls 18, 19 on a separate pivot axis 106 distinct from that at 14 for pivotal movement relative to the outer wall of the bucket which pivots at 14 defined by the mounting coupling. The rear wall which is generally radial to the pivot axis 14 and the cylindrical wall is thus movable from a retracted position at the rear 17 of the outer wall to a forward position in which the rear wall moves forwardly relative to the outer wall to push material from the outer wall for discharge.

A linkage 25 connected to an operating cylinder 30 of the digging machine for operating the system includes a link 26 for actuating pivotal movement of the bucket between forward and retracted positions and a pivotal lever 28 pivotally mounted on the sleeve at a pin 29 of the boom and operated by the cylinder with the link 26 at one end.

The cooperative quick coupling on the boom, which cooperates with the mounting coupling 102 of the bucket assembly, bridges between the pivot axis 14 and ends of the levers 26 that are remote from the operating cylinder.

The cleaning linkage includes a pair of arms 107 pivotally supported on a collar 108 which is mounted on the boom 11 generally at the second end 11A thereof, but more specifically at a spaced location from a terminus of the second end so as to be located rearwardly of the pin 29 at which the pivotal lever is mounted on the boom and which thus defines a coupling location whereat the linkage is operatively coupled to the boom. Each one of the pair of arms 107 is disposed on either side of the boom 11 with a proximal arm end 109 mounted on a torsion spring (schematically shown) which is supported on the collar 108 and a distal free end 112 of the arm which is located forwardly of the collar closer to the terminus of the boom at its second end 11A. Each arm projects forwardly from the collar and is located at a fixed location on the boom. The torsion spring for the respective arm biases the arm 107 upwardly about an arm pivot axis A which is defined by the torsion springs which themselves lie along a common axis perpendicularly to the boom.

Furthermore, each arm 107 extends from its proximal end 109 to its distal end 112 along an arcuate path such that the free end 112 is locatable forwardly beyond the pivot axis at 14 with a length of the arm between its ends 109, 112 being spaced upwardly over the pivot axis 14. Bucket further includes a rear wall 115 behind the pivotal cleaning wall 20.

The rear wall 115 includes a pair of slots 114 extending from a location in proximity to the pivot axis at 14 towards the front edge 16 of the bucket, each on a respective side of the coupling 26. The arms 107 are arranged and their free ends 112 located so as to pass through the slots 114 in the rear wall in order to engage the pivotal cleaning wall.

Thus, at an intermediate angular position of the bucket 103 between its forward and retracted positions each arm 107 passes through the respective slot 114 and engages the cleaning wall 20 so as to prevent it from continuing rearwardly in movement with the bucket. The cleaning wall 20 is typically biased towards the rear of the bucket, for example by torsion springs indicated at 116 (schematically shown) which are coaxially located at the cleaning wall pivot axis 106, so that while the cleaning wall is not engaged by the arms the cleaning wall 20 remains in fixed relation with the bucket at the rear wall 115. Furthermore, this rearward biasing of the pivotal cleaning wall allows the pivotal cleaning wall to move with the arm 107 upon abutment therewith so that the arm and cleaning wall 20 need not be removably fastened together in order to remain in contact.

Further, the linkage 25 at the pivotal levers 28 includes guide elements which guide movement of the fingers 107 both laterally and vertically so that the fingers are properly guided into the slots 114. That is the guides lift the fingers over the pivot pin 14 and control any side to side movement of the forward end 112 so that the forward enters the slot 114 as the end reaches the wall 115. In the embodiment shown the guides are defined by a component on the pin 29, but other components of the boom or the linkage 26 can be used.

A roller 129 is provided at the free end 112 of each arm so that free end rollably engages the cleaning wall 20 from the first position to the second position, and vice versa.

The bucket can be oversize by 100% relative to conventional buckets for the digging machine, that is it may be double the size of the conventional bucket, because the rear wall 20 ensures that the bucket is cleared.

Buckets of varying size or capacity may be used with the stopper arms which for a given manufacturer and model of digging machine are located at a prescribed distance on either side of a longitudinal center of the boom. As such, each slot in the bucket with a certain size or capacity is located at the prescribed distance from a center of the bucket such that the same stopper arms mounted on a common manufacturer/model of digging machine work with different size buckets of the type described herein that are coupled Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A bucket assembly for mounting on a boom of a digging machine comprising:

a mounting coupling for attachment to the boom for pivotal movement of the coupling about a bucket pivot axis transverse to the boom;

a bucket attached to the mounting coupling for pivotal movement about the pivot axis in a digging action;

the boom including a hydraulic operating cylinder mounted thereon for operating pivotal movement of the bucket with an operating linkage extending from the operating cylinder to the bucket for pivotal movement of the bucket about a bucket pivot axis for movement of the bucket forwardly and rearwardly between forward and retracted positions;

the bucket having an outer wall of the bucket with a front digging edge to cut into material to be lifted and with the outer wall trailing behind the front edge;

the bucket having side walls of the bucket for confining the material onto the outer wall;

a pivotal cleaning wall of the bucket being mounted on the bucket for pivotal movement about a wall pivot axis transverse to the bucket at or adjacent the rear wall so as to be movable from a retracted position to a forward position in which the pivotal cleaning wall moves forwardly relative to the outer wall to push material from the outer wall for discharge;

the pivotal cleaning wall being biased into the retracted position thereof;

the outer wall forming a part of a cylinder surrounding the wall pivot axis of the pivotal cleaning wall so that pivotal movement of the pivotal cleaning wall about the wall pivot axis causes an outer edge of the pivotal cleaning wall to sweep across the outer wall from the position at the rear wall to a position adjacent a front of the part of the cylinder and causes respective side edges of the pivotal cleaning wall to sweep over the side walls;

and a cleaning linkage comprising an elongate stiff pushing member connected to the boom at a rear end of the pushing member and extending therefrom forwardly to a forward end of the pushing member which, when the bucket moves rearwardly, contacts the pivotal cleaning wall for pushing pivotal movement of the cleaning wall between the retracted and forward positions thereof;

the rear end of the pushing member being connected to the boom by a pivot coupling which allows pivotal movement of the forward end of the pushing member relative to the boom;

a receptacle carried on the pivotal cleaning wall into which the forward end of the pushing member engages;

the receptacle and the forward end of the pushing member being arranged to allow the receptacle to separate from the forward end of the pushing member when the bucket is moved forwardly by said operating linkage and operating cylinder;

the forward end of the pushing member being arranged to engage into the receptacle as the bucket is moved rearwardly by said operating linkage and operating cylinder such that the pivotal cleaning wall is pushed forwardly by the pushing member as the bucket moves rearwardly.

2. The bucket assembly according to claim 1 wherein the wall pivot axis of the pivotal cleaning wall is positioned at a location different from the bucket pivot axis.

3. The bucket assembly according to claim 1 wherein the pivotal cleaning wall is biased by a spring toward the retracted position.

4. The bucket assembly according to claim 1 wherein the mounting coupling is connected to a rear wall of the bucket which has one or more openings to allow release of any material from behind the pivotal cleaning wall.

5. The bucket assembly according to claim 1 wherein the receptacle comprises a cup which allows movement of an end of the pushing member radially of the transverse axis.

6. The bucket assembly according to claim 1 wherein the receptacle is carried on a member projecting outwardly from the pivotal cleaning wall so that the receptacle is spaced rearwardly of the pivotal cleaning wall.

7. The bucket assembly according to claim 1 wherein the rear end of the pushing member is carried for pivotal movement on a pivot carried on a support bracket attached to the boom.

8. The bucket assembly according to claim 1 wherein the rear end of the pushing member is carried for pivotal movement on a pivot attached to the boom by a bracket which supports the pivot at a position spaced from the boom with the operating cylinder between the pivot and the boom.

9. The bucket assembly according to claim 8 wherein the support bracket includes a forward clamping portion bolted to the boom and rear extension portion extending along the boom over the operating cylinder to attach to a mounting of the rear end of the operating cylinder.

10. The bucket assembly according to claim 1 wherein the rear end of the pushing member is carried for pivotal movement on a pivot attached to the boom where the pivot is at a position located underneath the operating cylinder with the pushing member extending along a side of the operating cylinder.

11. The bucket assembly according to claim 1 wherein the pushing member can be retracted to a non-active position by pivotal movement to engage a latch.

12. The bucket assembly according to claim 1 wherein the pushing member is biased by a spring toward the wall pivot axis.

13. The bucket assembly according to claim 4 wherein the pushing member comprises a plate extending through a hole in the rear wall centrally between the side walls and located outwardly of the wall pivot axis between an outer edge of the mounting coupling and the outer wall.

14. The bucket assembly according to claim 4 wherein the pushing member comprises a pair of fingers each extending through a respective hole in the rear wall between a side edge of the mounting coupling and a respective side wall.

15. The bucket assembly according to claim 1 wherein an abutment on the pushing member acts to engage the operating linkage to move the pushing member into a required position on the cleaning wall as the bucket moves rearwardly.

16. The bucket assembly according to claim 1 wherein there is provided at least one stop member mounted on a side wall to prevent movement of the pivotal cleaning wall outside a front of the outer wall.

* * * * *